US012110653B2

(12) United States Patent
Stewart et al.

(10) Patent No.: US 12,110,653 B2
(45) Date of Patent: Oct. 8, 2024

(54) UNDERWATER EXCAVATION APPARATUS

(71) Applicant: Rotech Group Limited, Aberdeen Aberdeen (GB)

(72) Inventors: Kenneth Roderick Stewart, Aberdeen Aberdeensire (GB); Donald Stewart, Aberdeen Aberdeensire (GB)

(73) Assignee: Rotech Group Limited, Aberdeen Aberdeensire (GB)

( * ) Notice: Subject to any disclaimer, the term of this patent is extended or adjusted under 35 U.S.C. 154(b) by 0 days.

(21) Appl. No.: 17/973,241

(22) Filed: Oct. 25, 2022

(65) Prior Publication Data

US 2023/0138350 A1 May 4, 2023

Related U.S. Application Data

(62) Division of application No. 16/327,822, filed as application No. PCT/GB2017/052490 on Aug. 23, 2017, now Pat. No. 11,649,607.

(30) Foreign Application Priority Data

Aug. 24, 2016 (GB) ..... 1614460
Feb. 22, 2017 (GB) ..... 1702866

(51) Int. Cl.
*E02F 3/92* (2006.01)
*E02F 3/00* (2006.01)
(Continued)

(52) U.S. Cl.
CPC ..... *E02F 3/9243* (2013.01); *E02F 3/00* (2013.01); *E02F 3/88* (2013.01); *E02F 3/8858* (2013.01);
(Continued)

(58) Field of Classification Search
CPC ... E02F 3/9243; E02F 3/00; E02F 3/88; E02F 3/8858; E02F 3/92; E02F 3/9206;
(Continued)

(56) References Cited

U.S. PATENT DOCUMENTS 3,148,464 A * 9/1964 Jones ..... E02F 3/9275 415/206
3,855,367 A 12/1974 Webb
(Continued)

FOREIGN PATENT DOCUMENTS

CN 103282650 A 9/2013
CN 203239626 U 10/2013
(Continued)

OTHER PUBLICATIONS

Combined Search and Examination Report, Application No. GB1702866.3, dated Mar. 15, 2017.
(Continued)

*Primary Examiner* — Audrey B. Walter
(74) *Attorney, Agent, or Firm* — Dickinson Wright PLLC

(57) ABSTRACT

"There is disclosed an excavation apparatus (5), such as an underwater excavation apparatus, having means for producing, in use, at least one vortex, spiral or turbulent flow in a laminar flow of fluid, e.g. water. The excavation apparatus (5) comprises a rotor (10) having a rotor rotation axis (A), wherein, in use, flow of fluid past or across the rotor (10) is at a first angle (α) from the axis of rotation (A). The excavation apparatus (5) comprises the rotor (5) and means or an arrangement for dampening reactive torque on the apparatus (5) caused by rotation of the rotor (10), in use. The turbulent flow is provided within, such as within a (transverse) cross-section, of the laminar flow."

22 Claims, 9 Drawing Sheets

(51) Int. Cl.

| | |
|---|---|
| ***E02F 3/88*** | (2006.01) |
| ***E02F 5/02*** | (2006.01) |
| ***E02F 5/10*** | (2006.01) |
| ***E02F 5/28*** | (2006.01) |
| ***E02F 9/00*** | (2006.01) |
| ***F04D 29/18*** | (2006.01) |
| ***F04D 29/52*** | (2006.01) |
| ***F04D 29/66*** | (2006.01) |

(52) U.S. Cl.
CPC ..... *E02F 3/92* (2013.01); *E02F 3/9206* (2013.01); *E02F 5/107* (2013.01); *E02F 5/108* (2013.01); *E02F 9/00* (2013.01); *F04D 29/181* (2013.01); *F04D 29/528* (2013.01); *F04D 29/669* (2013.01); *E02F 5/02* (2013.01); *E02F 5/28* (2013.01)

(58) Field of Classification Search
CPC ... E02F 5/107; E02F 5/108; E02F 9/00; E02F 5/28; F04D 29/181; F04D 29/528; F04D 29/669
See application file for complete search history.

(56) References Cited

U.S. PATENT DOCUMENTS

| | | | | | |
|---|---|---|---|---|---|
| 4,063,849 | A * | 12/1977 | Modianos | ..... | F04D 29/445 415/218.1 |
| 5,487,644 | A * | 1/1996 | Ishigaki | ..... | F04D 1/04 415/206 |
| 6,053,663 | A | 4/2000 | Dikken | | |
| 6,430,848 | B1 | 8/2002 | Susman et al. | | |
| 8,701,314 | B2 * | 4/2014 | Redding | ..... | E02F 3/9206 37/344 |
| 2003/0228214 | A1 | 12/2003 | McBride | | |
| 2012/0085003 | A1 | 4/2012 | Goodin | | |

FOREIGN PATENT DOCUMENTS

| | | | | | |
|---|---|---|---|---|---|
| CN | 103526795 | A | | 1/2014 | |
| EP | 0328198 | A1 | | 8/1989 | |
| EP | 0527227 | A1 | | 2/1993 | |
| EP | 2317016 | A2 | | 5/2011 | |
| FR | 2565611 | A1 | | 12/1985 | |
| GB | 2297777 | A | | 8/1996 | |
| GB | 2301128 | A | * | 11/1996 | ..... E02F 3/9212 |
| GB | 2302348 | A | | 1/1997 | |
| GB | 2359103 | A | | 8/2001 | |
| GB | 2459700 | A | | 11/2009 | |
| GB | 2538974 | A | | 12/2016 | |
| GB | 201509446 | | | 3/2019 | |
| GB | 2553425 | B1 | | 4/2020 | |
| JP | 59217840 | A | | 12/1984 | |
| RU | 2147939 | C1 | | 4/2000 | |
| WO | 8805103 | A1 | | 7/1988 | |
| WO | 9827286 | A1 | | 6/1998 | |
| WO | 2004045775 | A1 | | 6/2004 | |
| WO | 2004065700 | A1 | | 8/2004 | |
| WO | 2010143982 | A1 | | 12/2010 | |

OTHER PUBLICATIONS

Combined Search and Examination Report, Application No. GB1712194.8, dated Aug. 22, 2017.
Combined Search and Examination Report, Application No. GB1712190.6, dated Jan. 23, 2018.
First Office Action from CN Application No. 201780051689.2 dated Dec. 9, 2020.

* cited by examiner

Mixed flow device: axial component gives volume flow, limited pressure (p) increase; adding radial component builds up p.

Anti-rotation vanes in nozzle

Section view of anti-rotation vanes

UNDERWATER EXCAVATION APPARATUS

CROSS REFERENCE TO RELATED APPLICATIONS

This U.S. utility patent application is a divisional of U.S. application Ser. No. 16/327,822 filed Feb. 23, 2019, which is a U.S. national stage application of PCT Application No. PCT/GB2017/052490, filed on Aug. 23, 2017, which claims priority from GB Patent Application Nos. 1702866.3 filed on Feb. 22, 2017 and 1614460.2 filed Aug. 24, 2016, the contents of which are incorporated herein by reference in their entireties.

FIELD OF INVENTION

This invention relates to an excavation apparatus, and in particular, though not exclusively, to an underwater (e.g. subsea) excavation apparatus. The invention also relates to an excavation system, device or tool, such as an underwater excavation system, device or tool, and to a method of excavation, such as underwater excavation.

The invention also pertains to an underwater excavation apparatus or system comprising means for disturbing soil or soils or the like of a seabed, ocean floor, lake bed, river bed or the like, e.g. for disturbing relatively firm soils.

BACKGROUND TO INVENTION

Mass flow excavators operate by directing a flow of high volume fluid under low pressure at a seabed to displace seabed material. This is in contradistinction to jet type apparatus which direct a flow of low volume fluid under high pressure at the seabed. A mass flow excavator is typically tethered from a vessel by means of a crane wire, which is used to lower and retrieve the excavator, and to maintain the excavator at a given distance from the area/seabed or structure requiring excavation, such as a subsea oil or gas pipeline. In order to control the excavation, sonar detection means can be used to allow the excavator operator to view the excavation in real time. Cameras and metal detection means can also be used to assist the operator.

Underwater mass flow excavation apparatus are known. For example, GB 2 297 777 A and WO 98/27286, also by a number of the present Inventors, the contents of which are incorporated herein by reference.

Mass flow excavation is a means of creating cavities in the seabed with relatively low pressure(s) (Kilopascals, KPa), e.g. sand and/or pre-loosened or disturbed material. The mass flow excavation may be assisted by a mechanical means or high pressure jetting means for agitating the seabed. These ancillary means of cutting the seabed then rely on mass flow excavation means to remove and disperse the seabed material. Mass flow excavators typically comprise a hollow body housing and at least one impeller or rotor provided within the housing which draws fluid into the housing and directs the fluid out of the housing towards the seabed.

Known mass flow excavators comprise impellers designed to draw in large volumes of fluid and to discharge the fluid at relatively low speed and low pressure—typically less than 6 m/s and less than 25 KPa. Due to the relatively low pressure and low fluid flow speed of mass flow excavation, many passes may be required to effectively excavate an area, as with each pass only a limited penetration of the seabed may be achieved. It is a further characteristic of mass flow excavation that trenches created in the seabed may be wide but shallow. This is because the mass flow excavator may first move looser material on the surface due to pressure limitations before penetrating firmer material underneath, creating a wide and ill-defined or uncontrolled excavation profile.

Further, mass flow excavation apparatus are primarily suitable for excavation by directing fluid at the seabed, but due to the low pressure nature of the apparatus, such are of limited use in the collection and removal of seabed material by suction. Thus after the mass flow device has disturbed the seabed material a separate tool—such as a centrifugal pump—may require to be deployed to suck up and remove the material.

It is an object of at least one embodiment of at least one aspect of the present invention to obviate or mitigate one or more problems or disadvantages in the prior art.

It is an object of at least one aspect of at least one embodiment of the present invention to provide a means to address a desire of excavating in a relatively controlled and rapid manner with well-defined seabed excavation profiles.

To distinguish from "mass flow" the term "controlled flow" is hereinafter used in connection with excavation with the present invention which may be configured to produce and/or direct a flow of fluid at a pressure of typically around 35 to 120 KPa and volume flow of typically around 1 $m^3$/S to 8 $m^3$/S. In contrast to mass flow devices, the higher pressure capability of the controlled flow device makes the controlled flow device suitable for excavation in both excavation (e.g. jetting) mode and also in suction mode where the device may be used for collection and transportation of seabed material away from an excavation site.

SUMMARY OF INVENTION

First Aspect

According to a first aspect of the present invention there is provided an excavation apparatus, such as an underwater excavation apparatus, having means or an arrangement for producing, in use, at least one vortex or spiral in a flow of fluid, e.g. water.

The at least one vortex may comprise a plurality of vortexes (vortices) which together may comprise a closed shape, e.g. circular, oval, elliptical or the like.

The vortex producing means may herein be referred to as a vortex generator(s).

The vortex producing means may, in use, cause a spiralling movement of fluid flowing out of or into the excavation apparatus.

The excavation apparatus may comprise at least one rotor or impeller, and preferably may comprise a (i.e. a single) rotor.

The excavation apparatus may comprise at least one stator, and preferably may comprise a (i.e. a single) stator.

The excavation apparatus may comprise a housing or hollow body. The housing may comprise an inlet and an outlet. In a first mode of operation, e.g. an excavation mode, the outlet may be directed towards or face an area or region to be excavated. In such mode the inlet may, at least in use, be provided higher than or above, e.g. directly above, the outlet. In an alternative or second mode of operation, e.g. suction mode, the inlet may be directed towards or face an area or region which has been excavated and/or requires cleared. In such mode the inlet may, at least in use, be provided lower than or below, e.g. directly below, the outlet.

The rotor and/or the stator may be provided in the housing. The housing may comprise an axis. The rotor and the stator may be arranged coaxially, e.g. upon the axis.

Beneficially, the rotor may be provided proximal the inlet and the stator may be provided proximal the outlet or vice versa.

The vortex producing means may be provided in, on or adjacent the outlet.

In one embodiment the vortex producing means may be provided on an inner surface of the housing. In an alternative embodiment the vortex producing means may be provided on a body, e.g. within the housing, e.g. within the outlet of the housing. The body may be provided on the housing axis, e.g. coaxially with the rotor and stator.

In one embodiment the vortex producing means may be provided on an outer surface of the body. In an alternative embodiment the vortex producing means may be provided on an inner surface of the body. In such case the body may comprise a ring.

The body may be attached to the housing, e.g. by one or more blades which may be circumferentially disposed.

The vortex generating means may comprise at least one pair, and preferably a plurality of pairs, of vortex generating means.

One member of a pair may generate a vortex spiralling in one direction, while another member of said pair may generate a vortex spiralling in another or counter direction.

The vortex generating means, e.g. pairs of vortex generating means, may be circumferentially disposed, e.g. on the housing or body.

Beneficially there may be provided six (6) pairs of vortex generating means.

Each vortex generating means may comprise a planar member or tooth, e.g. a triangular planar member. An edge of the planar member may be attached to the housing or body.

Each planar member may be disposed on the housing or body such that said edge of the planar member is disposed at an angle (e.g. acute angle) relative to the axis of the housing.

Planar members of each pair of vortex generating means may be disposed at opposing angles.

In use, e.g. in an excavation mode or in a suction mode, a fluid flow may enter the inlet and exit the outlet. Vortexes produced by the vortex generating means may be provided within a cross-section of the said fluid flow.

Second Aspect

According to a second aspect of the present invention there is provided an excavation apparatus, such as an underwater excavation apparatus, comprising a rotor having a rotor rotation axis, wherein, in use, flow of fluid past or across the rotor is at a first angle from the axis of rotation.

This arrangement may be beneficial in allowing excavation and/or suction modes of the apparatus. In excavation and suction mode fluid may flow from an inlet to an outlet of the excavation apparatus.

In use, fluid flow past or across the rotor may be non-axial to the axis of rotation of the rotor.

The excavation apparatus may comprise a housing or hollow body. The housing may comprise an inlet and an outlet. In a first mode of operation, e.g. an excavation mode, the outlet may be directed towards or face an area or region to be excavated. In such mode the inlet may, at least in use, be provided higher than or above, e.g. directly above, the outlet. In an alternative or second mode of operation, e.g. suction mode, the inlet may be directed towards or face an area or region which has been excavated and/or requires cleared. In such mode the inlet may, at least in use, be provided lower than or below, e.g. directly below, the outlet.

The rotor may comprise a first body, e.g. a first cone member.

The first angle may diverge away from the axis in a direction away from the inlet and towards the outlet.

An apex of the rotor cone may face the inlet.

The rotor may comprise a plurality of impellers or blades, e.g. aerofoil blades, which may be disposed, e.g. circumferentially disposed, on the rotor cone.

The excavation apparatus may further comprise a stator. The stator may be coaxial with the rotor. The stator may be provided between the rotor and the outlet.

Flow of fluid past or across the stator may be at a second angle from the axis of rotation of the rotor.

The stator may comprise a second body, e.g. a second cone member.

The second angle may converge towards the axis in a direction away from the inlet and towards the outlet.

An apex of the stator may face the outlet.

The stator may comprise a plurality of impellers or blades, e.g. aerofoil blades, which may be disposed on the stator cone.

The first angle may be in the range of 45° to 55° preferably around 50°.

The second angle may be in the range of 5° to 15°, and preferably around 10°.

Third Aspect

According to a third aspect of the present invention there is provided an excavation apparatus, such as an underwater excavation apparatus, comprising at least one rotor and means or an arrangement for dampening reactive torque on the apparatus caused by rotation of the rotor, in use.

Most preferably the torque dampening means does not comprise a second rotor, e.g. a second rotor counter-rotating to the at least one (single) rotor.

The excavation apparatus may comprise at least one rotor. In beneficial embodiments the at least one rotor comprises a single rotor.

The excavation apparatus may comprise at least one stator. In beneficial embodiments the at least one stator comprises a single stator.

The excavation apparatus may comprise a housing or hollow body. The housing may comprise an inlet and an outlet. In a first mode of operation, e.g. an excavation mode, the outlet may be directed towards or face an area or region to be excavated. In such mode the inlet may, at least in use, be provided higher than or above, e.g. directly above, the outlet. In an alternative or second mode of operation, e.g. suction mode, the inlet may be directed towards or face an area or region which has been excavated and/or requires cleared. In such mode the inlet may, at least in use, be provided lower than or below, e.g. directly below, the outlet.

The rotor and/or the stator may be provided in the housing. The housing may comprise an axis. The rotor and the stator may be arranged coaxially, e.g. upon the axis. The housing may be provided upon the axis. The rotor may be provided proximal the inlet and the stator may be provided proximal the outlet.

The rotor may comprise a first body, e.g. cone body, and a plurality of blades, disposed on, e.g. circumferentially around, the first body.

The stator may comprise a second body, e.g. cone body, and a plurality of further blades, disposed on, e.g. circumferentially around, the second body.

The torque dampening means may comprise or include the stator blades.

The stator blades may comprise a plurality of primary stator blades, and optionally secondary or splitter blades provided between adjacent pairs of primary stator blades.

The torque dampening means may comprise or include one or more anti-rotation vanes. The anti-rotation vanes may comprise aerofoils. The anti-rotation vanes may be provided between the rotor and the outlet. The anti-rotation vanes may be provided between the stator and the outlet.

The anti-rotation vanes may be provided at or adjacent the outlet.

The anti-rotation vanes may be provided within the housing, e.g. circumferentially disposed within the housing.

An outer end of each anti-rotation vane may be connected to an inner surface of the housing. An inner end of each anti-rotation vane may be connected to an outer surface of a/the ring provided within the housing.

Fourth Aspect

According to a fourth aspect of the present invention there is provided an excavation apparatus, such as an underwater excavation apparatus, comprising means or an arrangement for producing a laminar fluid flow and means or an arrangement for producing a turbulent fluid flow or vortex or spiral fluid flow within, such as a (transverse) cross-section of, the laminar flow.

A flow direction of the turbulent flow may be substantially parallel to a flow direction of the laminar flow.

The flow direction of the laminar flow and/or flow direction of the turbulent flow may be substantially parallel to a longitudinal axis of the excavation apparatus.

The turbulent flow may comprise a closed shape within, such as within a cross-section of, the laminar flow.

The turbulent flow may comprise at least one vortex or spiral and may comprise a plurality of vortexes (vortices) which together may comprise a closed shape, e.g. circular, oval, elliptical or the like.

The turbulent flow may be substantially central within the laminar flow and/or within an outlet of the apparatus.

The turbulent flow/vortex producing means may herein be referred to as a vortex generator(s).

The turbulent flow/vortex producing means may, in use, cause a spiralling movement of fluid flowing out of or into the excavation apparatus.

The excavation apparatus may comprise at least one rotor or impeller, and preferably may comprise a (i.e. a single) rotor.

The excavation apparatus may comprise at least one stator, and preferably may comprise a (i.e. a single) stator.

The excavation apparatus may comprise a housing or hollow body. The housing may comprise an inlet and an outlet. In a first mode of operation, e.g. an excavation mode, the outlet may be directed towards or face an area or region to be excavated. In such mode the inlet may, at least in use, be provided higher than or above, e.g. directly above, the outlet. In an alternative or second mode of operation, e.g. suction mode, the inlet may be directed towards or face an area or region which has been excavated and/or requires cleared. In such mode the inlet may, at least in use, be provided lower than or below, e.g. directly below, the outlet.

The rotor and/or the stator may be provided in the housing. The housing may comprise an axis which may comprise or be consistent with the longitudinal axis of the excavation apparatus. The rotor and the stator may be arranged coaxially, e.g. upon the axis. Beneficially, the rotor may be provided proximal the inlet and the stator may be provided proximal the outlet or vice versa.

The turbulent flow/vortex producing means may be provided in, on or adjacent the outlet.

In one embodiment the vortex producing means may be provided on an inner surface of the housing. In an alternative embodiment the vortex producing means may be provided on a body, e.g. within the housing, e.g. within the outlet of the housing. The body may be provided on the housing axis, e.g. coaxially with the rotor and stator.

In one embodiment the turbulent flow/vortex producing means may be provided on an outer surface of the body. In an alternative embodiment the vortex producing means may be provided on an inner surface of the body. In such case the body may comprise a ring.

The body may be attached to the housing, e.g. by one or more blades which may be circumferentially disposed.

The turbulent flow/vortex generating means may comprise at least one pair, and preferably a plurality of pairs, of vortex generating means.

One member of a pair may generate a vortex spiralling in one direction, while another member of said pair may generate a vortex spiralling in another or counter direction.

The turbulent flow/vortex generating means, e.g. pairs of turbulent flow/vortex generating means, may be circumferentially disposed, e.g. on the housing or body.

Beneficially there may be provided six (6) pairs of turbulent flow/vortex generating means.

Each turbulent flow/vortex generating means may comprise a planar member or tooth, e.g. a triangular planar member. An edge of the planar member may be attached to the housing or body.

Each planar member may be disposed on the housing or body such that said edge of the planar member is disposed at an angle (e.g. acute angle) relative to the axis of the housing.

Planar members of each pair of turbulent flow/vortex generating means may be disposed at opposing angles.

In use, e.g. in an excavation mode or in a suction mode, a fluid flow may enter the inlet and exit the outlet. Vortexes produced by the turbulent flow/vortex generating means may be provided within a cross-section of the said fluid flow.

In any of the foregoing aspects the following may be provided.

An inside and/or an outside of the housing may diverge (from an inlet) towards the rotor.

An inside and/or an outside of the housing may converge (from the stator) towards the outlet.

The housing may be circumferentially symmetrical about the axis.

In preferred embodiments, in use, fluid flowing through or exiting the excavation apparatus may typically have a total pressure of around 35 to 120 KPa and a volume flow rate of 1 to 8 $m^3/S$.

Further Aspects

According to a fifth aspect of the present invention there is provided an excavation system, device or tool, such as an underwater excavation system, device or tool, comprising at least one excavation apparatus according to the first, second, third or fourth aspects of the present invention.

According to a sixth aspect of the present invention there is provided a method of excavation, such as underwater excavation, the method comprising:

- providing at least one excavation apparatus according to the first, second, third or fourth aspects of the present invention;
- excavating a location, region or area, such as an underwater location, region or area, using said excavation apparatus.

It should be understood that any features defined above in accordance with any aspect of the present invention or below in relation to any specific embodiment of the invention may be utilised, either alone or in combination with any other feature defined in any other aspect or embodiment of the present invention.

BRIEF DESCRIPTION OF DRAWINGS

Embodiments of the present invention will now be described by way of example only, with reference to the accompanying drawings, which are:

FIG. 2(*b*) a schematic view of stator blades of an excavation apparatus according to an embodiment of the present invention;

FIG. 7(*b*) a partial sectional side view of the excavation apparatus of FIG. 7(*a*) to an enlarged scale;

DETAILED DESCRIPTION OF DRAWINGS PREFERRED EMBODIMENTS

Figure 1:
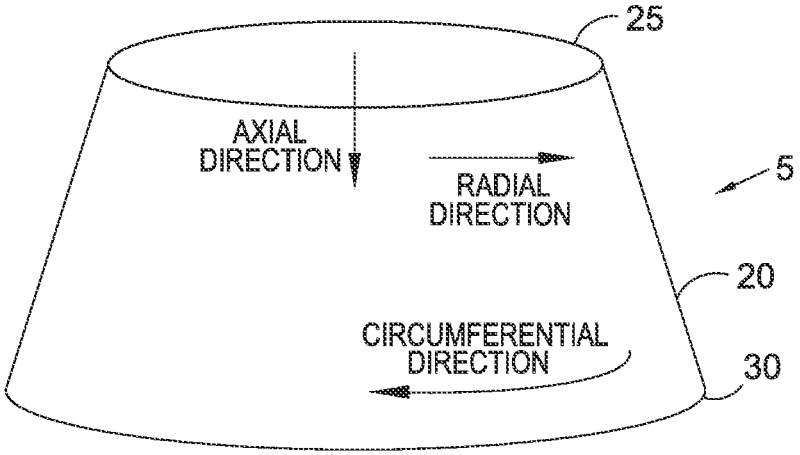
FIG. 1 a schematic diagram illustrating fluid flow through a hollow body of an excavation apparatus according to an embodiment of the present invention.

Embodiments of the present invention will now be described with reference to the accompanying drawings.

According to embodiments of the present invention there is provided an excavation apparatus 5, such as an underwater excavation apparatus, comprising a rotor 10 having a rotor rotation axis A, wherein, in use, flow of fluid past or across the rotor 10 is at a first angle α from the axis of rotation A.

This arrangement is beneficial in allowing excavation and/or suction modes of the apparatus 5. In excavation mode and suction mode, fluid flows from an inlet 25 to an outlet 30 of the excavation apparatus 5.

In use, fluid flow past or across the rotor 10 is non-axial to the axis of rotation A of the rotor 10.

The excavation apparatus 5 comprises a housing or hollow body 20. The housing 20 comprises inlet 25 and outlet 30. In a first mode of operation, e.g. excavation mode, the outlet 30 is directed towards or faces an area or region to be excavated. In such mode the inlet 25 is, at least in use, typically provided higher than or above, e.g. directly above, the outlet 30. In an alternative or second mode of operation, e.g. suction mode, the inlet 25 is directed towards or faces an area or region excavated and/or requires to be cleared. In such mode the inlet 25, is at least in use, provided lower than or below, e.g. directly below, the outlet 30.

The rotor 10 comprises a first body 39, e.g. a first cone member. The first angle α diverges away from the axis A in a direction away from the inlet 25 and towards the outlet 30. An apex of the rotor 10 faces the inlet 25. The rotor 10 comprises a plurality of impellers or blades 35, e.g. aerofoil blades, which are disposed, e.g. circumferentially disposed, on the rotor cone.

The excavation apparatus 5 further comprise a stator 15. The stator 15 is coaxial with the rotor 10. The stator 15 is provided between the rotor 10 and the outlet 30.

Flow of fluid past or across the stator 15 is at a second angle β from the axis of rotation of the rotor 10. The stator 15 comprises a second body 40, e.g. a second cone member. The second angle β converges towards the axis A in a direction away from the inlet 25 and towards the outlet 30.

An apex of the stator 15 faces the outlet 30. The stator 15 comprises a plurality of vanes or blades 45, e.g. aerofoil blades, which are disposed on the stator cone.

The first angle α is in the range of 45° to 55°, and beneficially around 50°.

The second angle β is in the range of 5° to 15°, and preferably around 10°.

The excavation apparatus 5, such as an underwater excavation apparatus, comprises at least one rotor 10 and means or an arrangement for dampening reactive torque on the apparatus 5 caused by rotation of the rotor 10, in use. Beneficially the at least one rotor 10 comprises a single rotor 10. The torque dampening means does not comprise a second rotor, e.g. second rotor counter-rotating to the at least one (single) rotor 10.

The excavation apparatus 5 comprises at least one rotor 10. In beneficial embodiments the at least one rotor 10 comprises a single rotor 10.

The excavation apparatus 5 may comprise at least one stator 15. In beneficial embodiments the at least one stator 15 comprises a single stator 15.

The excavation apparatus comprises a housing or hollow body 20. The housing 20 comprises inlet 25 and outlet 30. In a first mode of operation, e.g. excavation mode, the outlet 30 is directed towards or faces an area or region to be excavated. In such mode the inlet 25, at least in use, is typically provided above, e.g. directly above, the outlet 30. In an alternative or second mode of operation, e.g. suction mode, the inlet 25 is directed towards or faces an area or region excavated and/or requires to be cleared. In such mode the inlet 25, is at least in use, provided lower than or below, e.g. directly below, the outlet 30.

The rotor 10 and/or the stator 15 are provided in the housing 20. The housing 20 comprises an axis. The rotor 10 and the stator 15 are arranged coaxially, e.g. upon the axis A. The housing 20 is provided upon the axis A. The rotor 10 is provided proximal the inlet 25 and the stator 15 is provided proximal the outlet 30. The rotor 10 comprises a first body 39, e.g. cone body, and a plurality of blades 35, disposed on, e.g. circumferentially around, the first body 30.

The stator 15 comprises a second body 40, e.g. a further cone body, and a plurality of further blades 45, disposed on, e.g. circumferentially around, the second body 40. The torque dampening means comprises or includes the further blades 45. The stator blades 45 comprises a plurality of primary stator blades 46 and secondary or splitter blades 47 provided between adjacent pairs of primary stator blades 46.

The torque dampening means comprise or include one or more anti-rotation vanes 50. The anti-rotation vanes 50 comprise aerofoils. The anti-rotation vanes 50 are provided between the rotor 10 and the outlet 30. The anti-rotation vanes 50 are provided between the stator 15 and the outlet 30. The anti-rotation vanes 50 are provided at or adjacent the outlet 30. The anti-rotation vanes 50 are provided within the housing 20, e.g. circumferentially disposed within the housing 20.

An outer end of each anti-rotation vane 50 is connected to an inner surface of the housing 20. An inner end of each anti-rotation vane 50 is connected to an outer surface of a ring 55 provided within the housing 20.

An inside and/or an outside of the housing 20 diverges from the inlet 25 towards the rotor 10. An inside and/or an outside of the housing 20 converges from the stator 15 towards the outlet 30. The housing 20 is circumferentially symmetrical about the axis.

In preferred embodiments the fluid flowing through or exiting the excavation apparatus 5 typically has a pressure of around 35 to 120 KPa and a volume flow rate of 1 to 8 $m^3$/S.

In the disclosed embodiment, the excavation apparatus 5, such as an underwater excavation apparatus, has means or an arrangement 60 for producing, in use, at least one vortex or spiral in a flow of fluid, e.g. water.

The at least one vortex can comprise a plurality of vortexes which together can comprise a closed shape, e.g. circular, oval, elliptical or the like. The vortex producing means 60 hereinafter can be referred to as a vortex generator(s). The vortex producing means 60, in use, cause a spiralling movement of fluid flowing out of or into the excavation apparatus 5. The excavation apparatus 5 comprises at least one rotor 10 or impeller, and beneficially comprises a (i.e. a single) rotor 10. The excavation apparatus 5 comprises at least one stator 15, and beneficially comprises a (i.e. a single) stator 15.

The excavation apparatus 5 comprises housing or hollow body 20. The housing 20 comprises inlet 25 and outlet 30. In a first mode of operation, e.g. excavation mode, the outlet 30 is directed towards or faces an area or region to be excavated. In such mode the inlet, at least in use, is provided above, e.g. directly above, the outlet 30. In an alternative or second mode of operation, e.g. suction mode, the inlet 25 is directed towards or faces an area or region excavated and/or requires to be cleared. In such mode the inlet 25, is at least in use, provided lower than or below, e.g. directly below, the outlet 30.

The rotor 10 and/or the stator 15 is provided in the housing 20. The housing 20 comprises axis A. The rotor 10 and the stator 15 are arranged coaxially, e.g. upon the axis A. The rotor 10 is provided proximal the inlet 25 and the stator is provided proximal the outlet 30.

The vortex producing means 60 are provided in, on or adjacent the outlet 30.

In one embodiment the vortex producing means 60 are provided on an inner surface of the housing 20. In an alternative embodiment the vortex producing means 60 are provided on a body 65, e.g. within the housing 20, e.g. within the outlet of the housing 20. The body 65 is provided on the housing axis, e.g. coaxially with the rotor 10 and stator 15.

In one embodiment the vortex producing means 60 is provided on an outer surface of the body 65. In an alternative embodiment the vortex producing means 60 is provided on an inner surface of a tube or hollow body or can comprise a ring 55.

The vortex generating means 60 comprises at least one pair, and preferably a plurality of pairs, of vortex generating means 60. One member of a pair generates a vortex spiralling in one direction, while another member of said pair generates a vortex spiralling in another or counter direction. The vortex generating means 60, e.g. pairs of vortex generating means 60, are circumferentially disposed, e.g. on the housing or body 20. Beneficially there are provided six (6) pairs of vortex generating means 60.

Each vortex generating means 60 comprises a planar member or tooth, e.g. a triangular planar member. An edge of the planar member is attached to the housing or body 20. Each planar member is disposed on the housing or body 20 such that said edge of the planar member is disposed at an angle (e.g. acute angle) relative to the axis of the housing 20. Planar members of each pair of vortex generating means 60 are disposed at opposing angles.

In use, e.g. in an excavation mode, a fluid flow, exits the outlet 30. Vortexes produced by the vortex generating means 60 are provided within a cross-section of the said fluid flow.

The body 65 is attached to the housing 20, e.g. by one or more blades 50 which are circumferentially disposed.

Laminar Flow/Turbulent Flow

Figure 13:
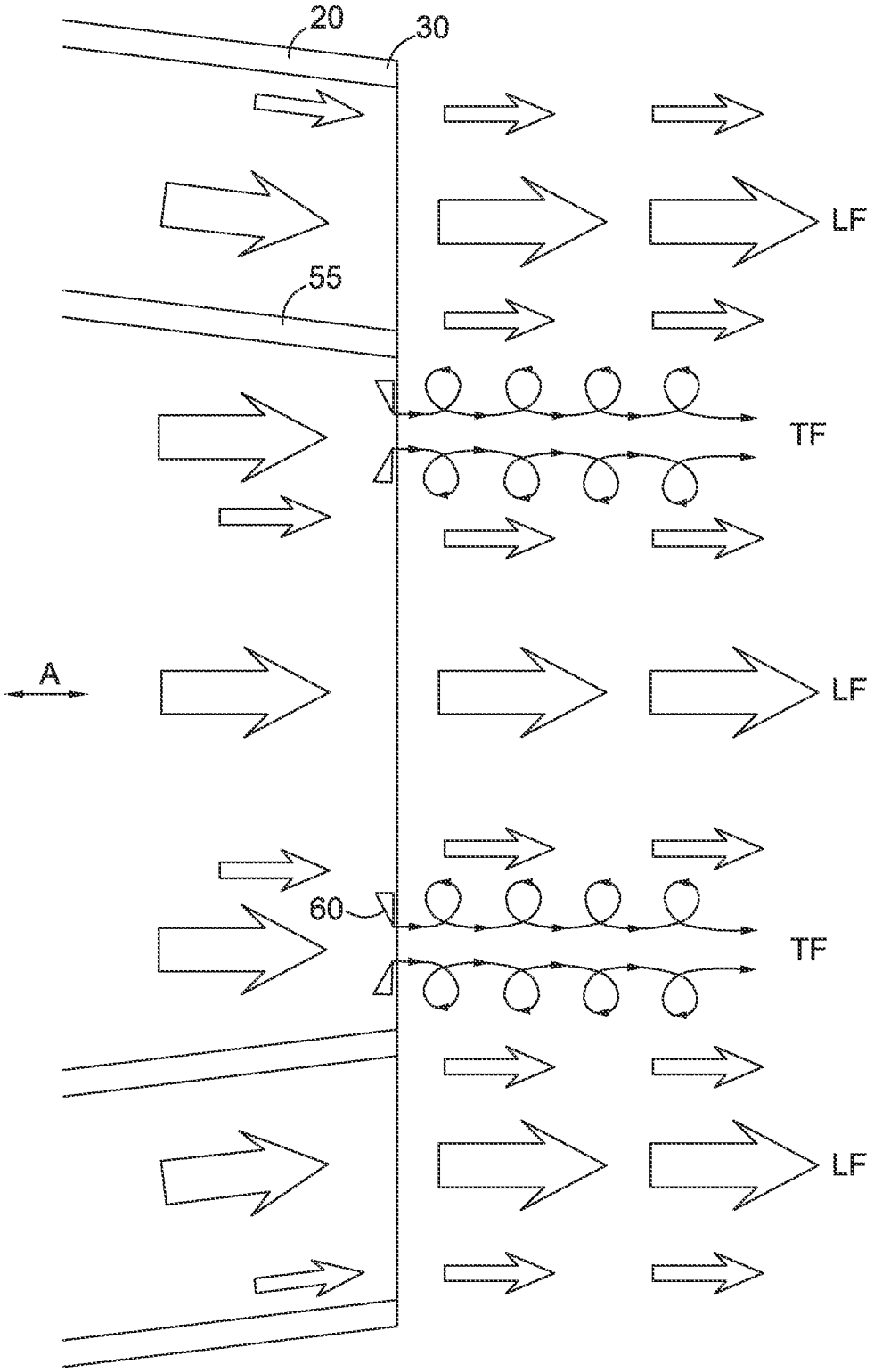
FIG. 13 a cross-sectional side view of an exit nozzle of an excavation apparatus according to an embodiment of the present invention illustrating laminar flow and turbulent flow exiting the exit nozzle, in use.
Figure 14:
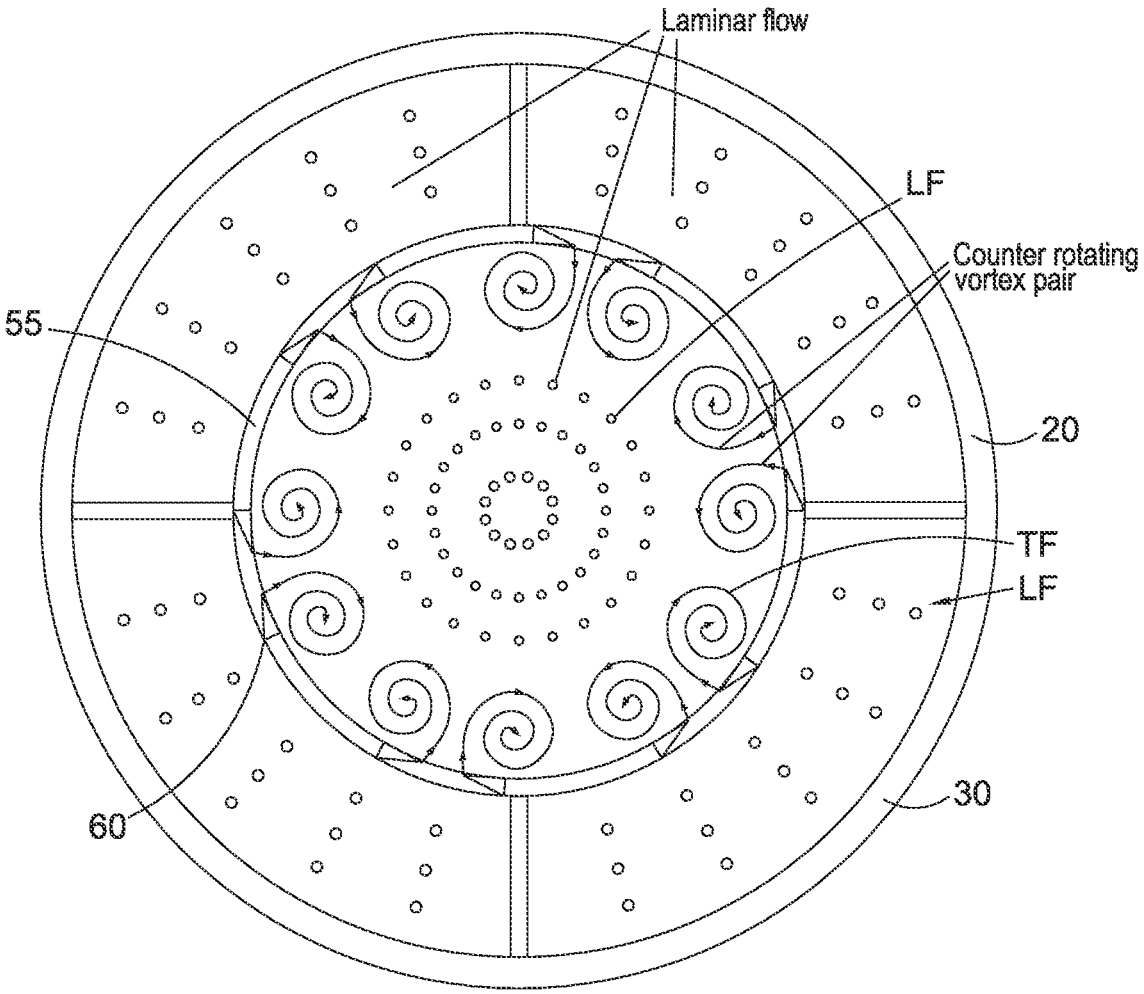
FIG. 14 a cross-sectional end view of the exit nozzle of the excavation apparatus of FIG. 13 illustrating the laminar flow and turbulent flow exiting the exit nozzle, in use.

Referring now to FIGS. 13 and 14, according to embodiments of the present invention hereinbefore described, the excavation apparatus 5, such as an underwater excavation apparatus, comprises means or an arrangement for producing a laminar flow LF and means or an arrangement for producing a turbulent flow TF or vortex or spiral flow, the turbulent flow being provided within the laminar flow LF. In this example the turbulent flow TF is provided within a cross-section (transverse cross-section) of the laminar flow LF.

The laminar flow LF is represented by arrows or dots, while the turbulent flow TF is represented by spiral/looped lines.

As can be seen from FIGS. 13 and 14, a flow direction of the turbulent flow TF is substantially parallel to a flow direction of the laminar flow LF. Also, in this embodiment, the flow direction of the laminar flow LF and/or flow direction of the turbulent flow TF is/are substantially parallel to a longitudinal axis A of the excavation apparatus 5.

As can also be seen from FIGS. 13 and 14, the turbulent flow TF comprises a closed shape within a transverse cross-section of the laminar flow LF, i.e. perpendicular to the flow direction. Also, in this embodiment, the closed shape of the turbulent flow TF is substantially centred within the laminar flow LF and within the outlet 30.

Non-Axial Rotor Fluid Flow

Hydrodynamic performance of subsea flow excavation devices is determined by factors such as:

- internal shape of the hollow body (or housing or shroud) which houses the impeller(s);
- impeller design;
- inlet and outlet design; and
- use of guide vanes within the device.

Known mass flow devices typically house impellers within simple tubular forms of hollow body and are designed so that the impellers receive and discharge the fluid with very little change of direction. See, for example, GB 2 240 568 A (SILLS), GB 2 297 777 A (DIKKEN) and EP 1 007 796 B1 (SUSMAN). In such prior art the impellers receive and discharge the flow in a purely axial direction. In SUSMAN a change of direction occurs after the fluid is discharged from the impeller. This axial configuration limits the amount of pressure that mass flow devices can impart from the impeller into the fluid. To generate the higher fluid speed and higher pressure within the controlled flow excavator according to the present invention, the impeller blade passages (formed by the combination of impeller hub, impeller blades and impeller shroud) as well as causing the fluid to rotate in a circumferential motion, also divert the fluid in a partly radial, partly axial direction (see FIG. 1). The partly radial nature of the impeller blades means that the circumferential speed at the trailing edge of the blade is higher than at the leading edge, thus imparting more kinetic energy into the fluid than an axial impeller blade running at the same speed. Use of an 'aerofoil' blade shape improves the hydrodynamic efficiency of the rotor blades.

In the controlled flow excavator according to the present invention the fluid leaves the impeller blades with a significant circumferential velocity, but also with both axial and radial velocities (see FIG. 1). Downstream of the impeller blade, the shape of the controlled flow apparatus flow passage, created by the housing and hub profiles, removes the radial component of the flow by turning from a mixed radial and axial direction to a purely axial direction. The fluid then travels axially but still with significant circumferential velocity and high kinetic energy at a relatively large radius. Blade passages of a stator section remove the circumferential component of flow, converting some of the kinetic energy into pressure energy, and bring the fluid back to a smaller radius for ejection from the excavator in a relatively small-diameter concentrated flow or jet.

Reactive Torque Dampening

Another feature of typical mass flow excavators is the means by which such cope with reactive torque transmitted from a drive mechanism into the fluid passing through the device. The fluid in turn exerts an equal and opposing torque on the housing in the opposite direction (reactive torque) which if not cancelled would make the body of the excavation device rotate in the opposite direction from the impeller, making the excavation device unstable in use. SILLS uses a number of clump weights deployed with the device to counteract the reactive torque; DIKKEN and SUSMAN employ two counter rotating impellers so that each impeller counteracts the reaction of the other.

Figure 2A:
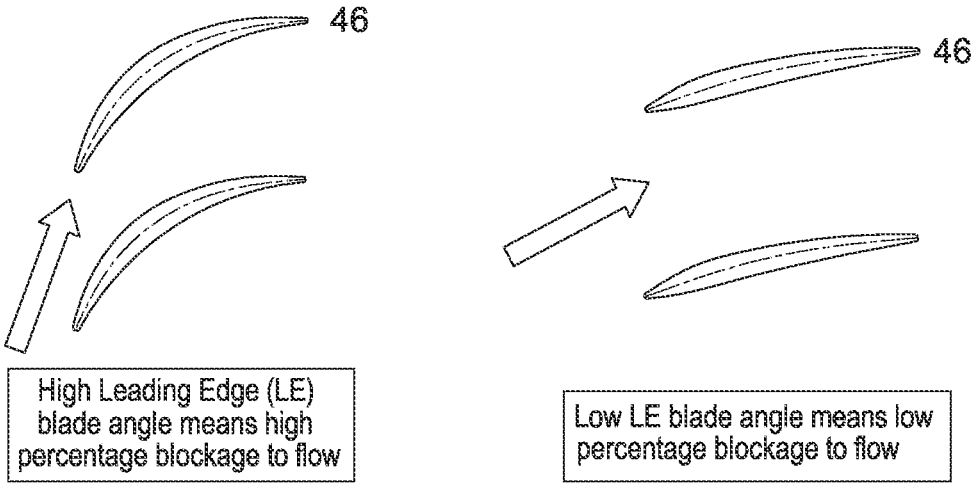
FIG. 2(*a*) a schematic view of stator blades.
Figure 2B:
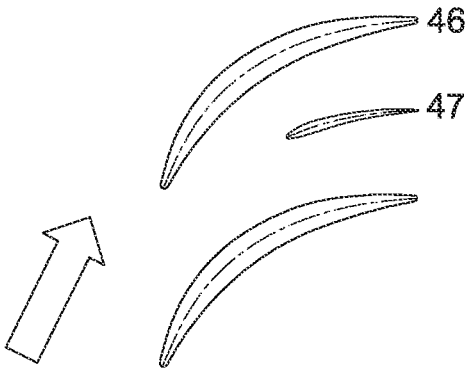

To avoid the need for complex devices to counteract reactive torque the controlled flow device of the invention provides guide vanes in a stator section after an impeller to straighten fluid flow. Substantially removing any circumferential motion or swirl caused by the impeller before the fluid exits the device substantially removes reactive torque from the excavator device. Because the fluid entering the stator has relatively high circumferential velocity compared to a conventional mass flow excavator, the stator blades must turn the fluid through significantly higher angles. This is achieved by a relatively higher number of stator blades of a relatively longer length, with a relatively higher blade angle at the LE (leading edge), and the use of a splitter blade. The higher the blade angle at the LE, the higher is the blockage caused by the blades, as shown in FIG. 2(*a*). This blockage effect limits the number of stator blades that can be efficiently used. As the fluid is turned, however, and the blades approach a more axial aspect, the effective gap between the blades increases, reducing the effectiveness of the blades in straightening the flow. A splitter blade, which is a small blade between each main blade, is therefore used to address this problem. The splitter blades increase the blading and hence help to straighten the flow but do not increase the blockage to an unacceptable level because they are only present in the area where the blade angles are smaller.

Particularly for operation in shallow water, it is important to seek to minimise a height of the controlled flow device, and while it would be simplest and less costly to house the stator blades in a purely cylindrical passage, i.e. one where the diameters do not change, in order to minimise length the stator is housed in a converging section, i.e. one where the diameter is reducing, so that the tasks of firstly removing the circumferential velocity from the fluid and converting kinetic into pressure energy, and secondly of bringing the fluid back to a smaller diameter for ejection through the nozzle, are combined in one section.

Figure 3:
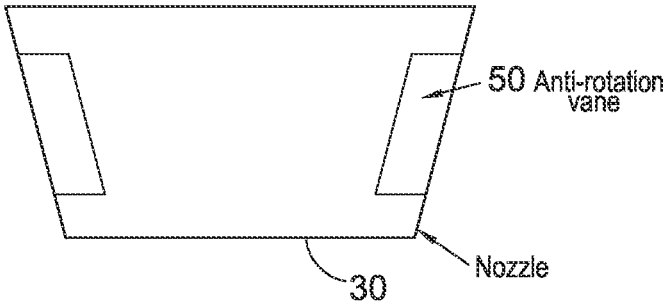
FIG. 3 a schematic side view of anti-rotation vanes of an excavation apparatus according to an embodiment of the present invention.
Figure 4:
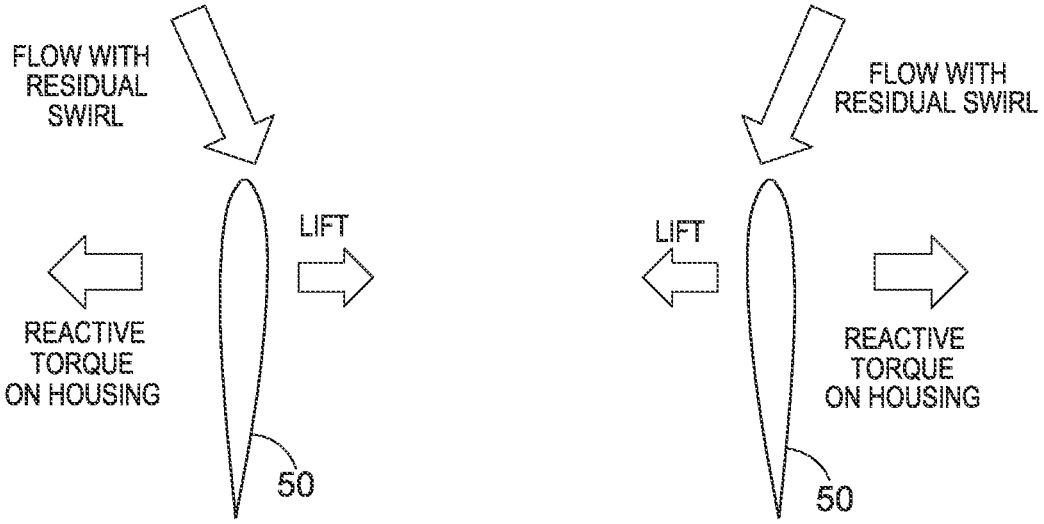
FIG. 4 a further schematic side view of the anti-rotation vanes of FIG. 3.
Figure 5:
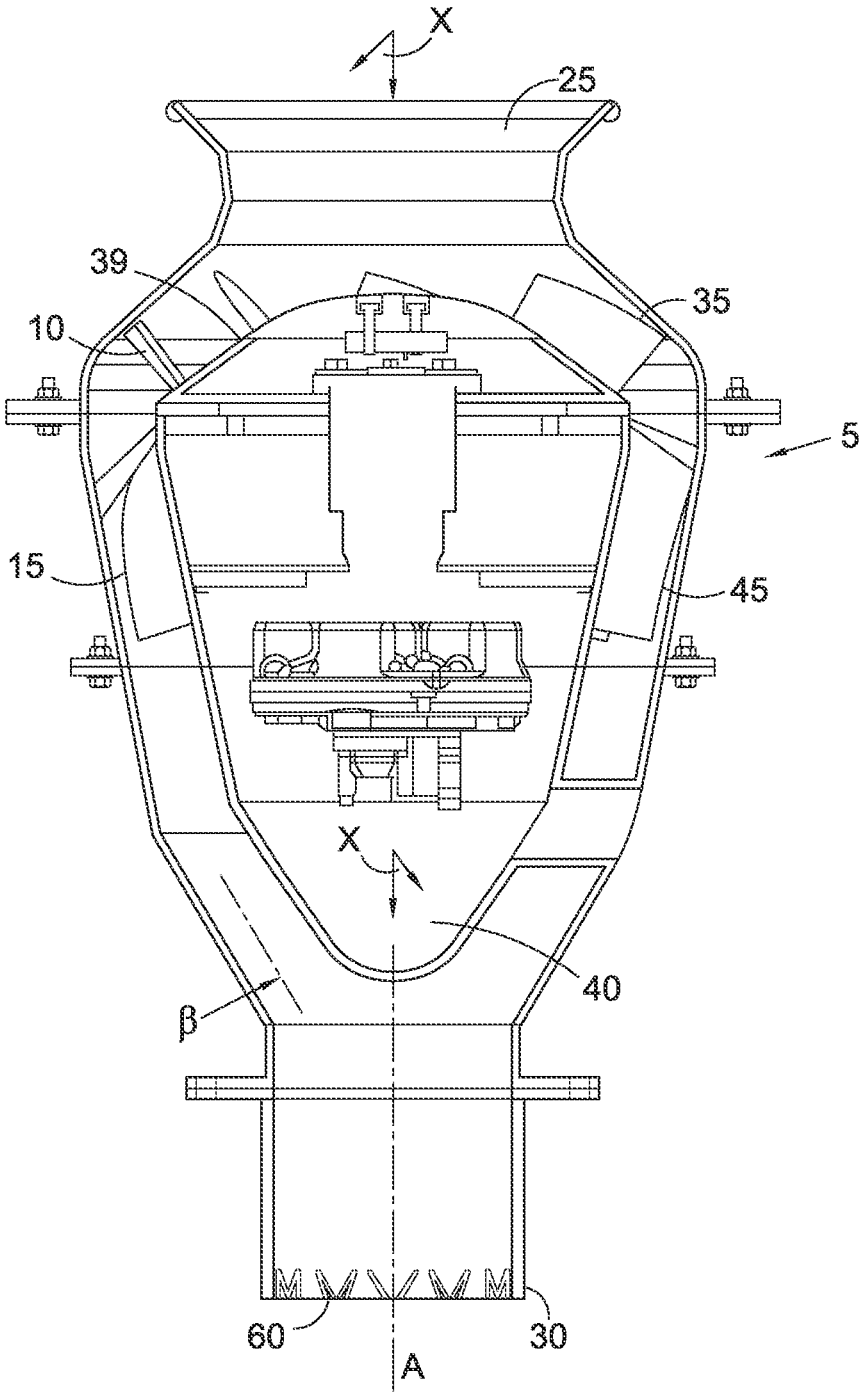
FIG. 5 a schematic side view of an excavation apparatus according to an embodiment of the present invention.

The controlled flow excavator seeks to achieve stability in the water by careful hydrodynamic stator blade design which seeks to ensure that when the excavation apparatus is running at designed operating parameters, the stator blades remove most if not all of the angular momentum from the fluid. Therefore, there is little residual reactive torque on the housing of the excavator. However, at 'off-design' conditions, i.e. where the excavator apparatus is being used with significantly greater or smaller rotor speeds than ideal operating point, there may remain a residual swirl in the fluid leaving the excavator apparatus. This means that the reactive torque may not have been fully eliminated by the stator blading. Anti-rotation blades attached to inside faces of nozzles near their outer diameter, as shown in FIG. 3, help to reduce or minimise any residual reactive torque. These anti-rotation blades convert some or all of any remaining rotational velocity in the fluid into torque in the opposite direction to the reactive torque which such residual swirl would produce. The anti-rotation blades are typically purely axial in profile with no camber (i.e. such are symmetrical about a chord-line running through the blade), which together with the use of an aerofoil profile induces lift in the desired direction regardless of which direction the fluid is swirling in. Hence a torque on the excavator housing is produced, in use, which partially or wholly offsets the reactive torque, as shown in FIG. 4. To reduce manufacturing costs, the anti-rotation blades may also be plane flat plates, and may for example be constructed from thick plate metal with, for example, rounded leading edges and sharpened trailing edges.

Vortex Generation

To further enhance the cutting capability of the controlled flow excavation apparatus, the exit nozzle of the apparatus can comprise a series of vortex generators to produce pairs of counter rotating vortexes. Vortex generators can be of a half delta wing profile or can be as simple as triangular or rectangular plates which are placed within the exit nozzle and are inclined to the flow to produce a strong vortex at the trailing edge of the vortex generator. The power of the vortex hitting the seabed locally weakens the area of the seabed to enable greater penetration by the controlled flow.

Figure 9:
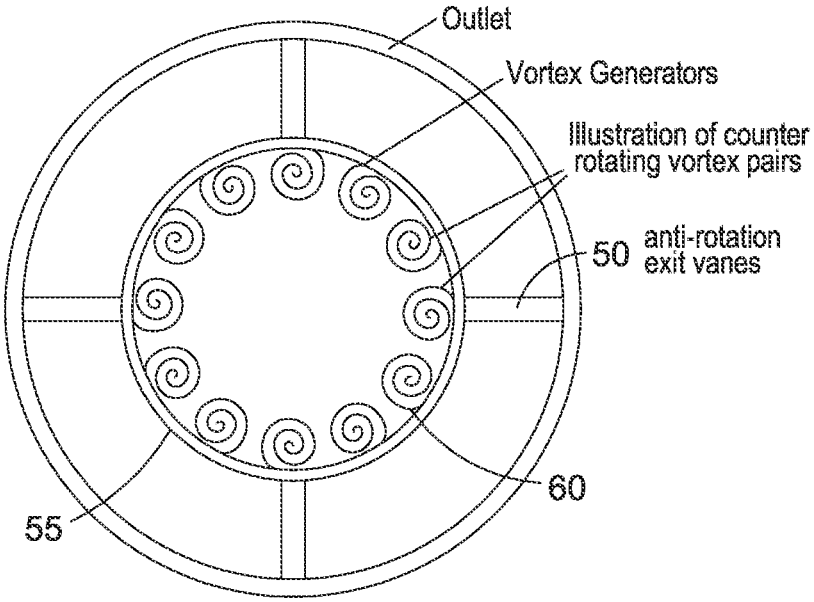
FIG. 9 a sectional view from above of the exit nozzle of the excavation apparatus of FIG. 8.
Figure 10:
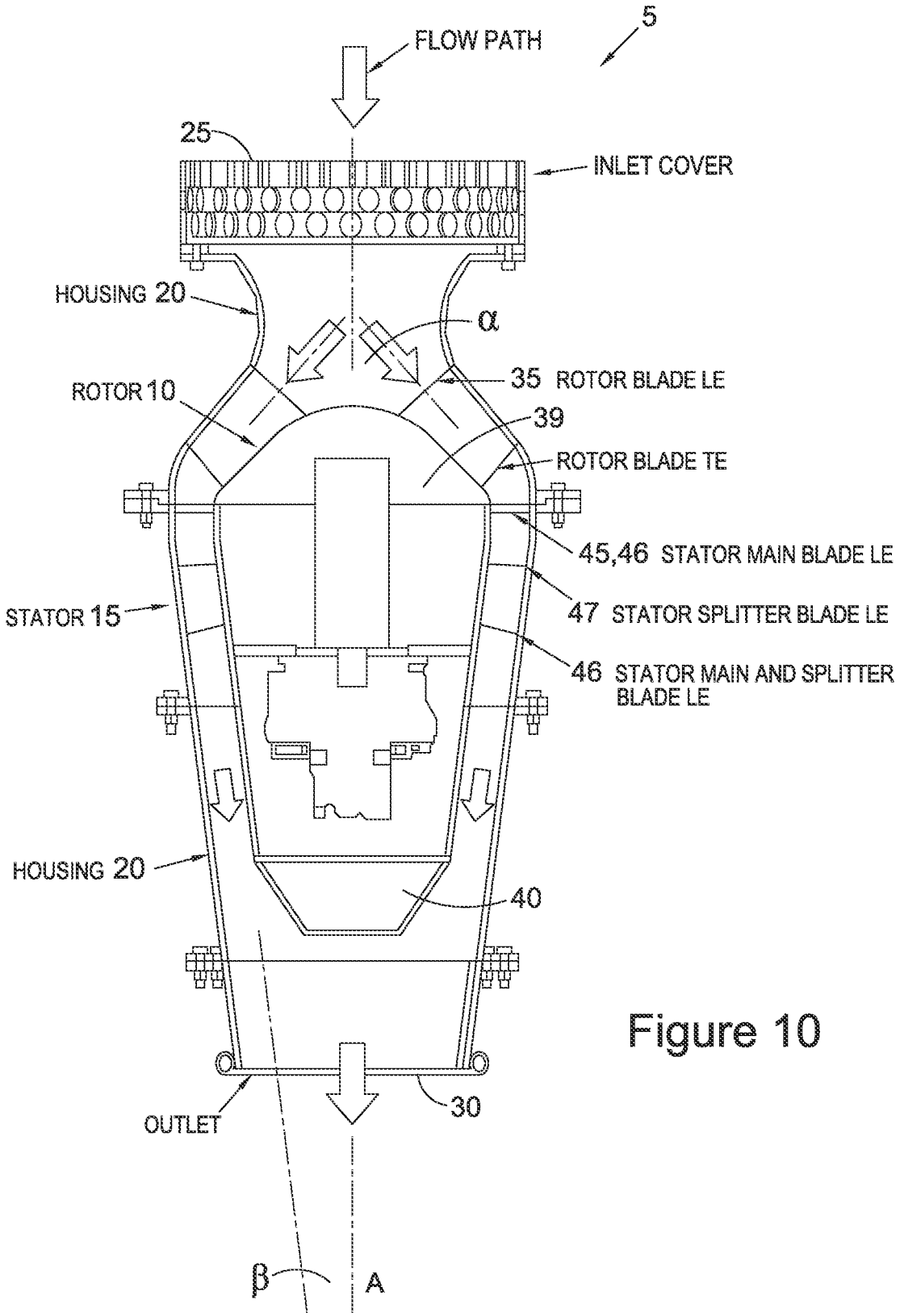
FIG. 10 a sectional side view of an excavation apparatus according to an embodiment of the present invention.
Figure 11:
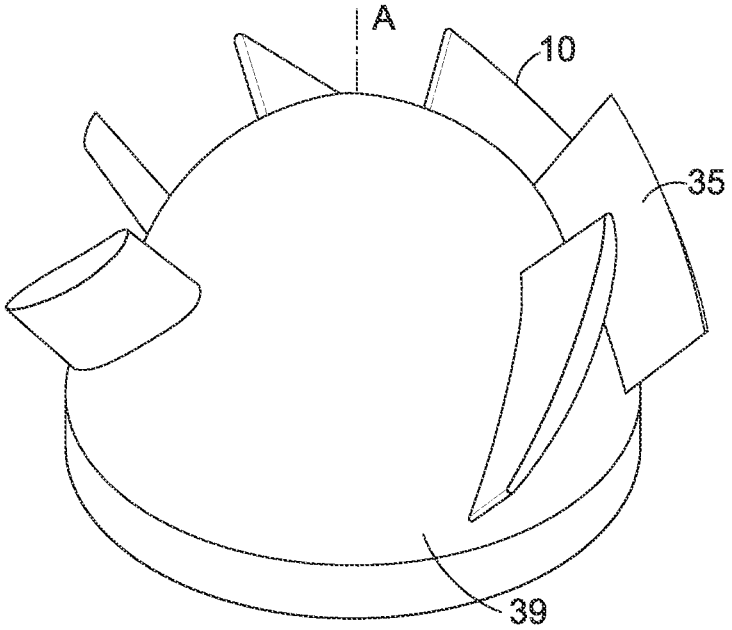
FIG. 11 a perspective view from above and to one side of a rotor of an excavation apparatus according to an embodiment of the present invention.
Figure 12:
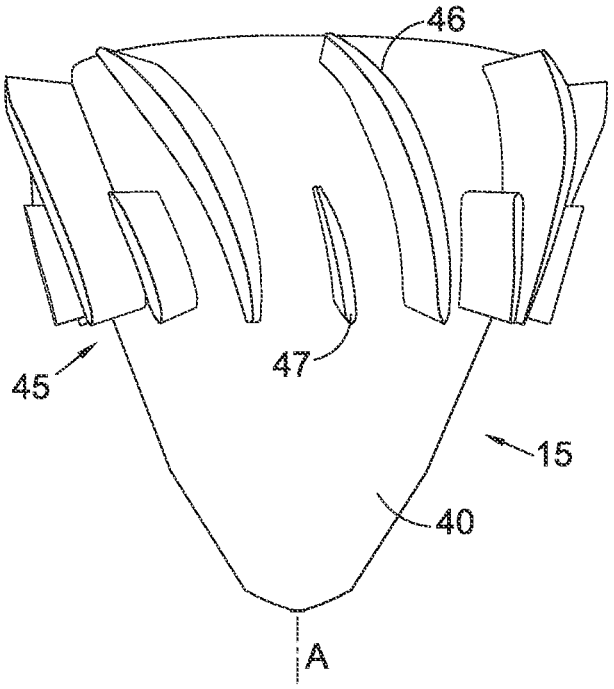
FIG. 12 a perspective view from above and to one side of a stator of an excavation apparatus according to an embodiment of the present invention.

By using counter rotating pairs each vortex helps contain and preserve the rotation of a neighbouring vortex(es) to produce more stable vortexes and avoid the creation of unwanted reactive torque as the torque from each vortex is cancelled by its neighbour (see FIG. 9).

The anti-rotation vanes can also be used in conjunction with vortex generators as described below, particularly to locate and support a ring of vortex generating pairs.

Figure 6:
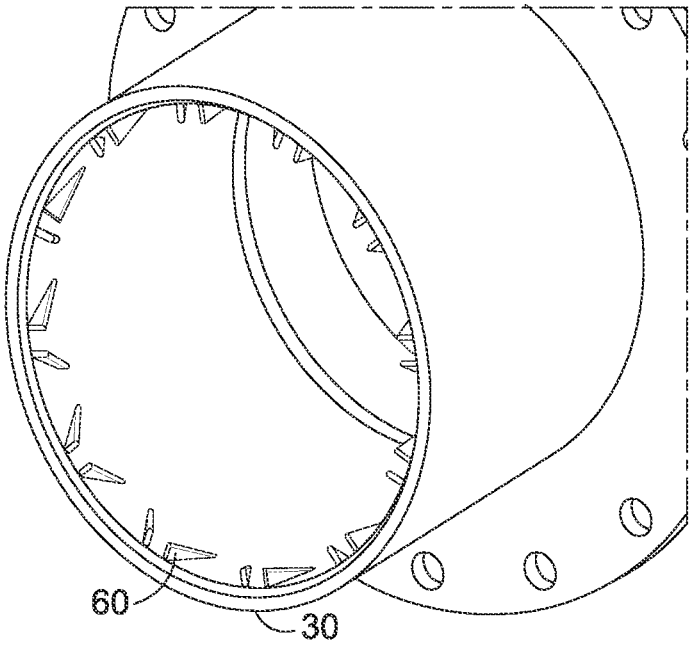
FIG. 6 a perspective view from below and to one side of an exit nozzle of the excavation apparatus of FIG. 5.

The number of vortex pairs can be maximised by placement of the vortex generators at the outer diameter of the exit nozzle (see FIG. 6).

Such placement has potential to cause mixing of the exiting fluid from the controlled flow device and the body of fluid in which the device is being used, thereby slowing and causing dispersal of the controlled flow.

Figure 7A:
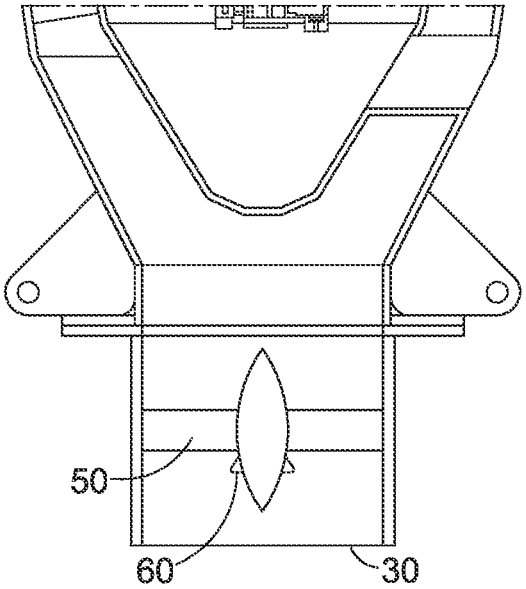
FIG. 7(*a*) a partial sectional side view of an excavation apparatus according to an embodiment of the present invention.
Figure 7B:
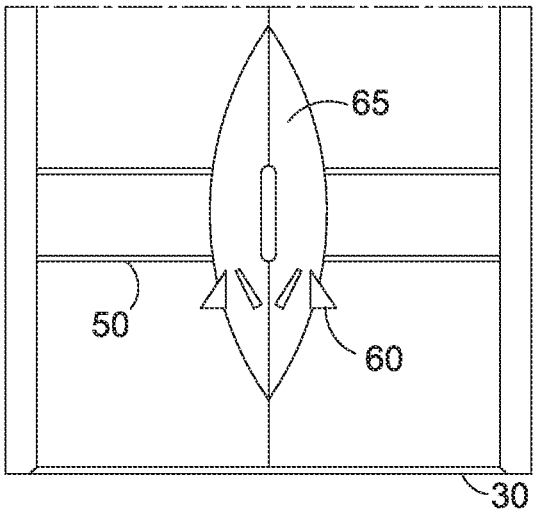

In an alternative embodiment (see FIGS. 7(*a*) and 7(*b*)), the vortex generators can be placed substantially in a centre of the exit nozzle, e.g. on a feature created to hold the vortex generators. However this arrangement allows for only a more limited number of pairs of vortex generators.

Figure 8:
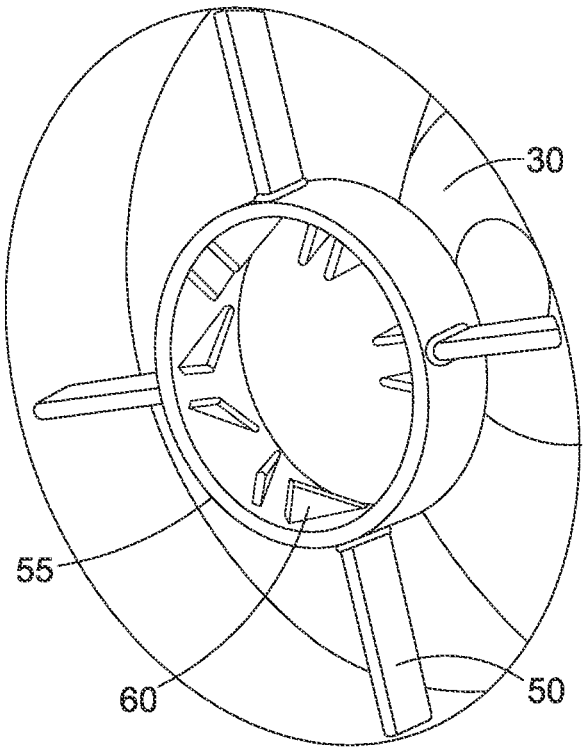
FIG. 8 a perspective view from below and to one side of an exit nozzle or outlet of an excavation apparatus according to an embodiment of the present invention.

In a further alternative embodiment (see FIG. 8), the vortex generators can be placed on a ring within the exit nozzle so that a greater number of pairs may be used, while maintaining the vortexes wholly within the high speed flow from the controlled flow devices. Maintaining the vortexes wholly within the high speed flow helps to create stable vortexes. Supports which attach the vortex ring to the nozzle may be in the form of anti-rotation blades as discussed above.

When used in suction mode the exit of the controlled flow apparatus can be connected to a pipe or hose for transportation of a slurry mix of fluid and seabed material (or spoil) away from the excavation site. Operating in this mode, the vortex generators in the exit of the controlled flow apparatus aid the transport of seabed material by mixing of the fluid which maintains the collected material in suspension.

It will be understood that in order to transport the excavated material along the transportation pipe that the ratio of seabed material to water being transported should preferably not exceed a ratio of approximately 15% to 20% solids to water. This ratio can be controlled by varying the power supplied to the controlled flow apparatus.

To transport material over long distances, say 200 meters or further, it may be necessary to add another controlled flow apparatus in series either directly coupled after the first controlled flow apparatus or some distance along the transportation pipe.

It will be appreciated that the embodiments of the invention hereinbefore described are given by way of example only, and are not meant to be limiting of the invention in any way.

It will be appreciated that modifications may be made to the disclosed embodiments. For example, the turbulent means or vortex producing means or vortex generator(s) may be provided on the anti-rotation vanes, e.g. on an inner edge(s) of the anti-rotation vanes.

What is claimed is:

1. An underwater excavation apparatus comprising:

a housing comprising an inlet and an outlet;

a rotor wholly provided within the housing and having a rotor rotation axis, wherein the rotor comprises a first body and a plurality of blades, the rotor configured such that, in use, flow of fluid past or across the rotor is at a first angle from the rotor rotation axis, the first angle diverging away from the rotor rotation axis in a direction away from the inlet and towards the outlet; and a stator provided within the housing between the rotor and the outlet, wherein the stator comprises a second body and a plurality of blades, the stator configured such that, in use, flow of fluid past or across the stator is at a second angle from the rotor rotation axis, the second angle converging towards the rotor rotation axis in said direction away from the inlet and towards the outlet, and wherein a portion of the inside of the housing in which the plurality of blades of the stator are provided converges towards the rotor rotation axis in said direction away from the inlet and towards the outlet, wherein:

in a first mode of operation, comprising an excavation mode, the apparatus is configured so that the outlet faces an area to be excavated and the inlet is provided above the outlet; and in a second mode of operation, comprising a suction mode, the apparatus is configured so that the inlet faces an area which has been excavated and/or requires to be cleared, and the inlet is provided lower than or below the outlet.

2. The underwater excavation apparatus as claimed in claim 1, wherein the plurality of blades of the rotor comprise aerofoil blades.

3. The underwater excavation apparatus as claimed in claim 1, wherein the plurality of blades of the stator comprise aerofoil blades.

4. The underwater excavation apparatus as claimed in claim 1, wherein the housing is circumferentially symmetrical about the rotor rotation axis.

5. The underwater excavation apparatus as claimed in claim 1, wherein the apparatus is configured so that fluid flowing or exiting the underwater excavation apparatus has a total pressure of 35 to 120 KPa and a volume flow rate of 1 to 8 $m^3$/S.

6. The underwater excavation apparatus as claimed in claim 1, wherein the rotor is an impeller.

7. The underwater excavation apparatus as claimed in claim 1, wherein at least one of:

a portion of the inside of the housing between the inlet and the rotor converges towards the rotor rotation axis in said direction away from the inlet and towards the outlet;

a portion of the inside of the housing between the inlet and the rotor diverges from the rotor rotation axis in said direction away from the inlet and towards the outlet;

a portion of the inside of the housing in which the plurality of blades of the rotor are provided diverges from the rotor rotation axis in said direction away from the inlet and towards the outlet.

8. The underwater excavation apparatus as claimed in claim 1, wherein the stator is coaxial with the rotor.

9. The underwater excavation apparatus as claimed in claim 1, wherein the underwater excavation apparatus comprises a controlled flow underwater excavation apparatus.

10. The underwater excavation apparatus as claimed in claim 1, wherein the first body comprises a first cone member.

11. The underwater excavation apparatus as claimed in claim 10, wherein at least one of:

an apex of the first cone member faces the inlet; and the plurality of blades of the rotor are circumferentially disposed on the first cone member.

12. The underwater excavation apparatus as claimed in claim 1, wherein the second body comprises a second cone member.

13. The underwater excavation apparatus as claimed in claim 12, wherein at least one of:

an apex of the second cone member faces the outlet; and the plurality of blades of the stator are disposed on a tapered section of the second cone member.

14. The underwater excavation apparatus as claimed in claim 1, wherein at least one of:

the first angle is selected from a range of 45°55°;

the second angle is selected from a range of 5° to 15°.

15. The underwater excavation apparatus as claimed in claim 14, wherein at least one of:

the first angle is 50°; and the second angle is 10°.

16. The underwater excavation apparatus as claimed in claim 1, comprising means for dampening reactive torque on the underwater excavation apparatus caused by rotation of the rotor, in use.

17. The underwater excavation apparatus as claimed in claim 16, wherein at least one of:

the means for dampening reactive torque comprises one or more anti-rotation vanes provided within the housing between the rotor and the outlet; and the means for dampening reactive torque comprises the blades of the stator, wherein the blades of the stator comprise a plurality of primary stator blades and secondary or splitter blades provided between adjacent pairs of the primary stator blades.

18. An underwater excavation system, device or tool comprising at least one underwater excavation apparatus according to claim 1.

19. An underwater excavation apparatus comprising:

a housing comprising an inlet and an outlet;

a rotor wholly provided within the housing and having a rotor rotation axis, wherein the rotor comprises a first body and a plurality of blades, the rotor configured such that, in use, flow of fluid past or across the rotor is at a first angle from the rotor rotation axis, the first angle diverging away from the rotor rotation axis in a direction away from the inlet and towards the outlet; and a stator provided within the housing between the rotor and the outlet, wherein the stator comprises a second body and a plurality of blades, the stator configured such that, in use, flow of fluid past or across the stator is at a second angle from the rotor rotation axis, the second angle converging towards the rotor rotation axis in said direction away from the inlet and towards the outlet, and wherein a portion of the inside of the housing in which the plurality of blades of the stator are provided converges towards the rotor rotation axis in said direction away from the inlet and towards the outlet, and a vortex producing arrangement for producing a plurality of vortices in a flow of fluid flowing out of the underwater excavation apparatus.

20. The underwater excavation apparatus as claimed in claim 19, wherein the or each at least one vortex producing arrangement is provided in, on or adjacent to the outlet of the housing and comprises one or more pairs of vortex generating means, said one or more pairs of vortex generating means comprising:

a first, planar, member disposed on the housing or on a body within the housing, the first, planar, member disposed at a first angle relative to an axis of the housing and thus configured to generate in said flow of fluid a vortex spiraling in a first direction; and a second, planar, member disposed on the housing or on the body within the housing, the second, planar, member disposed at a second, opposing, angle relative to the axis of the housing and thus configured to generate in said fluid flow a vortex spiraling in a second direction counter to the first direction.

21. The underwater excavation apparatus as claimed in claim 19, comprising an arrangement for producing a laminar fluid flow in the flow of fluid flowing out of the underwater excavation apparatus, wherein the vortex producing arrangement is configured to produce said plurality of vortices within the laminar flow.

22. A method of underwater excavation, the method comprising:

providing at least one underwater excavation apparatus, the at least one underwater excavation apparatus comprising:

a housing comprising an inlet and an outlet;

a rotor wholly provided within the housing and having a rotor rotation axis, wherein the rotor comprises a first body and a plurality of blades, the rotor configured such that, in use, flow of fluid past or across the rotor is at a first angle from the rotor rotation axis, the first angle diverging away from the rotor rotation axis in a direction away from the inlet and towards the outlet; and a stator provided within the housing between the rotor and the outlet, wherein the stator comprises a second body and a plurality of blades, the stator configured such that, in use, flow of fluid past or across the stator is at a second angle from the rotor rotation axis, the second angle converging towards the rotor rotation axis in said direction away from the inlet and towards the outlet, and wherein a portion of the inside of the housing in which the plurality of blades of the stator are provided converges towards the rotor rotation axis in said direction away from the inlet and towards the outlet; and excavating an underwater location using said underwater excavation apparatus.

* * * * *